US008827091B2

(12) United States Patent
Yokoyama et al.

(10) Patent No.: US 8,827,091 B2
(45) Date of Patent: Sep. 9, 2014

(54) CRANE AND METHOD OF ASSEMBLING CRANE

(75) Inventors: Shozo Yokoyama, Akashi (JP); Tomohiko Murata, Akashi (JP); Kenji Onuki, Akashi (JP); Hirohito Sato, Akashi (JP); Kunio Wakamatsu, Akashi (JP); Shinji Goto, Akashi (JP); Yutaka Kobayashi, Akashi (JP); Eiji Miya, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 1964 days.

(21) Appl. No.: 10/588,843

(22) PCT Filed: Mar. 31, 2005

(86) PCT No.: PCT/JP2005/006252

§ 371 (c)(1),
(2), (4) Date: Aug. 9, 2006

(87) PCT Pub. No.: WO2005/095255

PCT Pub. Date: Oct. 13, 2005

(65) Prior Publication Data

US 2007/0175849 A1 Aug. 2, 2007

(30) Foreign Application Priority Data

| | | |
|---|---|---|
| Mar. 31, 2004 | (JP) | 2004-107268 |
| Nov. 17, 2004 | (JP) | 2004-333468 |
| Feb. 7, 2005 | (JP) | 2005-031121 |
| Feb. 7, 2005 | (JP) | 2005-031122 |

(51) Int. Cl.

| | |
|---|---|
| ***B66C 23/44*** | (2006.01) |
| ***B66C 23/82*** | (2006.01) |
| ***B66C 23/62*** | (2006.01) |

(52) U.S. Cl.

CPC ..... *B66C 23/82* (2013.01); *B66C 23/62* (2013.01)

USPC ..... 212/181

(58) Field of Classification Search

CPC ..... B66C 17/00; B66C 23/62; B66C 23/82

USPC ..... 212/181, 301

See application file for complete search history.

(56) References Cited

U.S. PATENT DOCUMENTS

| | | | | |
|---|---|---|---|---|
| 3,184,076 | A * | 5/1965 | Brown et al. | 212/305 |
| 4,195,740 | A * | 4/1980 | Beduhn et al. | 212/235 |

(Continued)

FOREIGN PATENT DOCUMENTS

| | | |
|---|---|---|
| EP | 0 806 525 A2 | 11/1997 |
| EP | 1 336 773 | 8/2003 |

(Continued)

OTHER PUBLICATIONS

Link-Belt Construction Equipment, "Lifting Capacities Hydraulic Lattice Boom Crawler Crane LS-208H II", copyright 2000, #6258, pp. 1-12.*

(Continued)

*Primary Examiner* — Emmanuel M Marcelo

(74) *Attorney, Agent, or Firm* — Oblon, Spivak, McClelland, Maier & Neustadt, L.L.P.

(57) ABSTRACT

[PROBLEMS] To provide a rotating frame of an upper rotating body such that total productivity can be improved, the cost can be reduced, and model change can be facilitated.

[MEANS FOR SOLVING PROBLEMS] Many models having different lifting capacities are divided into a plurality of classes each including a plurality of models. A rotating frame 17 is determined on the basis of the model having the largest lifting capacity in each class. An upper rotating body is constructed using the rotating frame 17 as the base. In addition, each of winches 5 to 7 is mounted on the rotating frame by using a mounting structure standardized in the same class. On the other hand, left and right deck frames 18 and 19 are divided into sections on which different pieces of equipment are mounted, and the sections are separately attached to the rotating frame 17.

8 Claims, 16 Drawing Sheets

(56) References Cited

U.S. PATENT DOCUMENTS

| | | | | |
|---|---|---|---|---|
| 4,729,486 | A * | 3/1988 | Petzold et al. | 212/302 |
| 4,946,051 | A * | 8/1990 | Cliff | 212/258 |
| 5,598,935 | A * | 2/1997 | Harrison et al. | 212/197 |
| 5,934,395 | A | 8/1999 | Koide et al. | |
| 6,244,449 | B1 * | 6/2001 | Pech | 212/170 |
| 6,390,947 | B1 | 5/2002 | Aoki et al. | |
| 6,474,485 | B1 * | 11/2002 | Yokoyama | 212/195 |
| 6,520,358 | B1 | 2/2003 | Kobayashi et al. | |
| 2003/0064854 | A1 | 4/2003 | Kotani | |
| 2003/0078134 | A1 | 4/2003 | Kojima et al. | |
| 2003/0085043 | A1 | 5/2003 | Muta et al. | |
| 2003/0171187 | A1 | 9/2003 | Aoki et al. | |
| 2004/0084233 | A1 | 5/2004 | Wakuta et al. | |
| 2005/0124457 | A1 | 6/2005 | Nakamori et al. | |

FOREIGN PATENT DOCUMENTS

| | | |
|---|---|---|
| JP | 47-31773 | 8/1972 |
| JP | 61-28782 | 2/1986 |
| JP | 63-23421 | 6/1988 |
| JP | 6-92274 | 4/1994 |
| JP | 8-266012 | 10/1996 |
| JP | 2542385 | 4/1997 |
| JP | 10-114969 | 5/1998 |
| JP | 10-212983 | 8/1998 |
| JP | 10-245863 | 9/1998 |
| JP | 10-338420 | 12/1998 |
| JP | 2000-230442 | 8/2000 |
| JP | 2000-308207 | 11/2000 |
| JP | 2001-41067 | 2/2001 |
| JP | 2001-112114 | 4/2001 |
| JP | 2002-003165 | 1/2002 |
| JP | 2002-89307 | 3/2002 |
| JP | 2002-97667 | 4/2002 |
| JP | 2002-118901 | 4/2002 |
| JP | 2002-155865 | 5/2002 |
| JP | 02/47931 | 6/2002 |
| JP | 2002-225578 | 8/2002 |
| JP | 2003-201089 | 7/2003 |
| JP | 2003-205768 | 7/2003 |
| JP | 2004-277165 A * | 9/2004 |
| JP | 2004-277165 | 10/2004 |

OTHER PUBLICATIONS

Link-Belt Construction Equipment, "LS-208H II HYLAB Series", copyright 2000, #4246, pp. 1-2.*

Link-Belt Construction Equipment, "Specifications Lattice Boom Crawler Crane LS-208H II", copyright 2002, #5350, pp. 1-8.*

Link-Belt Construction Equipment, "Specifications Lattice Boom Crawler Crane LS-108H II", copyright 2002, #5360, pp. 1-8.*

Link-Belt Construction Equipment, "LS-108H II HYLAB Series", copyright 2001, #4273, pp. 1-6.*

Link-Belt Construction Equipment "Link-Belt Lattice Boom Crawler Cranes", copyright 2000-2003, Mar. 17, 2003, pp. 1-2.*

U.S. Appl. No. 09/421,216, filed Oct. 20, 1999, Kobayashi, et al.

* cited by examiner

FIG. 6

| CLASS, MODEL / ELEMENT | CLASS A | CLASS B | CLASS C | CLASS D | CLASS E |
|---|---|---|---|---|---|
| | A1, A2··· | B1, B2··· | C1, C2··· | D1, D2··· | E1, E2··· |
| ROTATING FRAME 12 | COMMON I | COMMON II | COMMON III | COMMON IV | COMMON V |
| MOUNTING STRUCTURE OF WINCHES 5 TO 7 | COMMON I | COMMON II | COMMON III | COMMON IV | COMMON V |
| OUTER SHAPES AND SIZES OF LEFT AND RIGHT DECK FRAMES 18 AND 19 | COMMON I | COMMON II | COMMON III | COMMON IV | COMMON V |
| MOUNTING STRUCTURE OF EQUIPMENT MOUNTED ON DECK FRAMES | COMMON I | COMMON II | COMMON III | COMMON IV | COMMON V |
| MOUNTING STRUCTURE OF EACH SECTION OF DECK FRAMES | COMMON I | COMMON II | COMMON III | COMMON IV | COMMON V |

FIG. 7

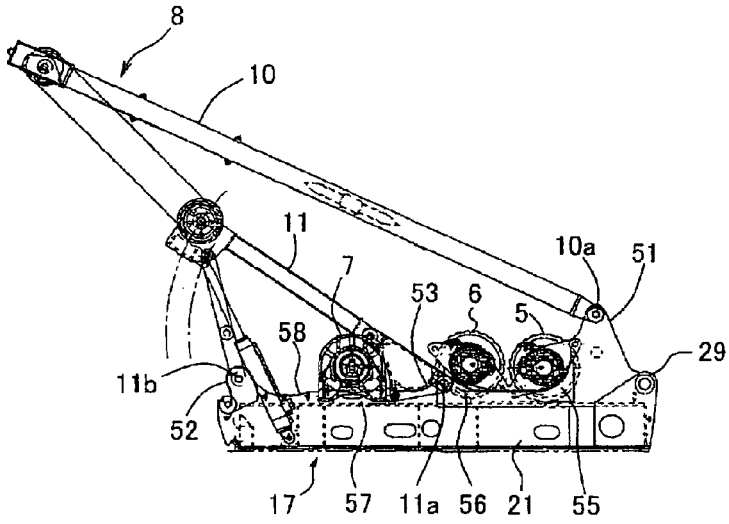

CRANE AND METHOD OF ASSEMBLING CRANE

TECHNICAL FIELD

The present invention relates to a mobile crane such as a crawler crane or a wheel crane and a method for assembling the same.

BACKGROUND ART

A crawler crane will be described as an example.

As shown in FIG. 20, a crawler crane includes a crawler-type lower traveling body 1 and an upper rotating body 2 mounted thereon rotatably around a vertical axis.

The upper rotating body 2 includes a rotating frame 3 shown in FIG. 21, which serves as a base. Deck frames (not shown) are attached to both the left and right sides of the rotating frame 3. A boom 4 that can be raised and lowered, three winches (a main winch 5, a subwinch 6, and a boom raising and lowering winch 7), a boom raising and lowering apparatus that raises and lowers the boom 4, and other various necessary pieces of equipment are mounted on the rotating frame 3 and the deck frames.

Many crane models having different lifting capacities are manufactured according to country-specific specifications and standards, specifications required by customers, and so on.

Hitherto, as disclosed in Patent Document 1, rotating frames 3 having different specifications (shapes, sizes, and so on) have been prepared according to individual models, and equipment has been mounted on such a dedicated rotating frame 3 to each model so as to construct an upper rotating body 2.

Specifically, for example, for four models whose lifting capacities are 50 tonnes, 55 tonnes, 65 tonnes, and 80 tonnes, four dedicated rotating frames for 50 tonnes, 55 tonnes, 65 tonnes, and 80 tonnes have been respectively designed and manufactured, and cranes have been assembled on the basis of the rotating frames.

The boom raising and lowering apparatus is selected from two types: a mast apparatus 8 shown in FIG. 20 as a solid line, and a gantry apparatus 9 shown in FIG. 20 as a two-dot chain line and also shown in FIG. 21.

The mast apparatus 8 includes a mast 10. The lower end of the mast 10 is attached to the front of the rotating frame 3. The mast 10 is pivotable around a horizontal axis. A crane can be assembled and disassembled by using the mast apparatus 8 instead of the boom without using another crane. In addition, since the backward protrusion is large, the mast apparatus 8 is suitable for an environment where the rear end radius is not limited. Therefore, the mast apparatus 8 is used mainly outside Japan.

The gantry apparatus 9 is mounted on the rotating frame 3 pivotably with the front and rear lower ends as fulcrums. The gantry apparatus 9 requires an environment where another crane for assembling and disassembling is easily available. In addition, since the backward protrusion is small, the gantry apparatus 9 is suitable for an environment where the rear end radius is limited. Therefore, in Japan, the gantry apparatus 9 is mainly used.

In general, the number of winches is three as described above, and the main winch 5, the subwinch 6, and the boom raising and lowering winch 7 are mounted on the rotating frame 3 in this order from the front at intervals.

In the case of a crane using the gantry apparatus 9, according to the request of the user or the kind of work being performed, separately from the above three standard winches, a third winch 12 (see FIG. 21) for supplementary work can be added as an optional winch. The "third" winch 12 is a winch next to the main winch 5 and the subwinch 6.

In this case, in order to avoid the interference of wire ropes, the main winch 5, the subwinch 6, the third winch 12, and the boom raising and lowering winch 7 are mounted on the rotating frame 3 in this order from the front. That is to say, the three-winch-type boom raising and lowering winch 7 needs to be moved from the third position to the fourth position.

In this case, since the boom raising and lowering winch 7 normally differs from the third winch 12 in size, two types of mounting structure are necessary.

Therefore, the rotating frame 3 needs to be provided with boom-raising-and-lowering-apparatus mounting structures corresponding to the two types of boom raising and lowering apparatuses (the mast apparatus 8 and the gantry apparatus 9), a three-winch-type winch mounting structure, and a four-winch-type winch mounting structure.

That is to say, mounting structures for the following three combinations are necessary:

(i) mast apparatus 8 and three-winch-type winches;

(ii) gantry apparatus 9 and three-winch-type winches; and (iii) gantry apparatus 9 and four-winch-type winches.

If the standard winches can be replaced with different-sized winches, the types of mounting structure further increase in number.

In FIG. 20, reference numeral 13 designates a rotation bearing for rotatably mounting the upper rotating body 2 on the lower traveling body 1, reference numeral 14 designates a cabin provided on the right-hand side of the front of the upper rotating body 2, reference numeral 15 designates a counterweight provided in the rear of the upper rotating body 2, and reference numeral 16 designates a lifting hook raised and lowered by the main winch 5.

Patent Document 1: Japanese Patent No. 3,436,157

DISCLOSURE OF INVENTION

However, the crane and method for assembling the same disclosed in Patent Document 1 have the following problems.

(I) Concerning Rotating Frame 3

Since it is necessary to use so many types of rotating frames, that is to say, the same number of rotating frames as models, the costs of the design, manufacturing, and storage of the rotating frames 3 are high. In addition, if the rotating frame 3 is changed, the parts used therefor and the equipment mounted thereon are also changed. Therefore, the costs of the parts and manufacturing are also high.

Moreover, since it is necessary to use different rotating frames 3, parts, and equipments for different models, total productivity (assemblability) is very low.

Furthermore, if a model change due to a destination change is requested during manufacturing, the whole rotating frame 3 needs to be changed, even if the model change is small (for example, from 50 tonnes to 55 tonnes).

(II) Concerning Boom Raising and Lowering Apparatus and Winches

As described above, on the basis of the combinations of the boom raising and lowering apparatuses and the winches 5 to 7 and 12, at least three types of mounting structures are used. Therefore, it is very disadvantageous in terms of inventory control, cost, and dealing with the crane specification change due to destination change.

The present invention provides a crane that can easily solve the above problems, that is to say, a crane including a rotating frame such that total productivity (assemblability) can be improved, the cost can be reduced, and model change can be facilitated.

In addition, the present invention provides a crane that can increase the effect of standardization of the rotating frame by standardizing the mounting structure of two types of boom raising and lowering apparatuses (a mast apparatus and a gantry apparatus).

Moreover, the present invention provides a crane that can increase the effect of standardization of the rotating frame by standardizing the mounting structure of a plurality of types of winches (for example, three-winch and four-winch).

Furthermore, the present invention provides a crane that can further increase the effect of standardization of the rotating frame by standardizing the mounting structures of both the two types of boom raising and lowering apparatuses and the plurality of types of winches.

To solve the above problems, the present invention adopts the following configurations.

A crane includes a lower traveling body and an upper rotating body rotatably mounted on the lower traveling body. The upper rotating body includes a rotating frame and lifting equipment mounted on the rotating frame. The lifting equipment includes a boom and a plurality of types of winches. Many models having different lifting capacities are divided into a plurality of classes, each class including a plurality of models. The models included in each class share a common rotating frame. The common rotating frame is based on the model having the largest lifting capacity in each class. The rotating frame included in the upper rotating body is such a common rotating frame.

A crane includes a lower traveling body and an upper rotating body rotatably mounted on the lower traveling body. The upper rotating body includes a rotating frame, a boom, a boom raising and lowering apparatus, and a winch. The boom, the boom raising and lowering apparatus, and the winch are mounted on the rotating frame. The boom raising and lowering apparatus is selected from a plurality of types of boom raising and lowering apparatuses. The rotating frame is common in a class including a plurality of models having different lifting capacities and is based on the model having the largest lifting capacity in the class. The rotating frame includes common boom-raising-and-lowering-apparatus mounting portions that are common to the plurality of types of boom raising and lowering apparatuses.

A crane includes a lower traveling body and an upper rotating body rotatably mounted on the lower traveling body. The upper rotating body includes a rotating frame, a boom, a boom raising and lowering apparatus, and a plurality of winches. The boom, the boom raising and lowering apparatus, and the winches are mounted on the rotating frame. The rotating frame is common in a class including a plurality of models having different lifting capacities and is based on the model having the largest lifting capacity in the class. The rotating frame includes a common winch mounting portion that is shared by a plurality of types of winches having different sizes.

A crane includes a lower traveling body and an upper rotating body rotatably mounted on the lower traveling body. The upper rotating body includes a rotating frame, a boom, a boom raising and lowering apparatus, and a plurality of winches. The boom, the boom raising and lowering apparatus, and the winches are mounted on the rotating frame. The boom raising and lowering apparatus is selected from a plurality of types of boom raising and lowering apparatuses. The rotating frame is common in a class including a plurality of models having different lifting capacities and is based on the model having the largest lifting capacity in the class. The rotating frame includes common boom-raising-and-lowering-apparatus mounting portions that are common to the plurality of types of boom raising and lowering apparatuses. The rotating frame further includes a common winch mounting portion that is shared by a plurality of types of winches having different sizes.

In the crane and method for assembling the same of the present invention, many models having different lifting capacities are divided into classes, each including a plurality of models, the plurality of models included in each class share a common rotating frame, the common rotating frame being based on the model having the largest lifting capacity in each class, and an upper rotating body is constructed using the rotating frame as the base. Therefore, the costs of the design, manufacturing, and storage of the rotating frames can be dramatically reduced. In addition, due to the standardization of the rotating frame, the costs of the parts and manufacturing can also be reduced.

Since it is not necessary to use different rotating frames, parts, and equipments for different models, the total productivity can be dramatically improved.

If a model change due to a destination change is requested during manufacturing, as long as the change is within the same class (for example, a change to 50 tonnes to 55 tonnes), the rotating frame need not be changed, and it is only necessary to change the equipment. Therefore, the model change can be easily dealt with.

Since the rotating frame is common not to all models but to a plurality of models in each class (the range of standardization is limited), the balance between the size and cost of models can be maintained. For example, if the rotating frame is determined on the basis of the model having the largest lifting capacity in all models, a small-capacity model has a too large rotating frame, and the cost increases. Such an adverse effect can be eliminated.

In addition to sharing a common rotating frame by a plurality of types of models in the same class, the mounting structure of the boom raising and lowering apparatus, the mounting structure of the winches, and both of them are standardized.

When there are two types of boom raising and lowering apparatuses, three-winch-type winches, and four-winch-type winches, the mast apparatus and the gantry apparatus can be mounted with a common mounting portion. Therefore, mounting structures only for the following two combinations are necessary: a boom raising and lowering apparatus and three-winch type, and a boom raising and lowering apparatus and four-winch type.

The rotating frame includes a common winch mounting portion that is shared by a plurality of types of winches having different sizes. Therefore, only one type of rotating frame is necessary regardless of variation in winch size.

That is to say, since the boom raising and lowering apparatuses or winches to be mounted on the rotating frame can be combined, the effect of standardization of the rotating frame can be increased.

In addition, only one type of mounting structure for boom raising and lowering apparatuses and only one type of mounting structure for winches are necessary.

Therefore, the sharing of a common rotating frame by a plurality of models can be utilized, and this crane has a great advantage in many aspects such as cost, productivity, inventory control, and model change.

BRIEF DESCRIPTION OF THE DRAWINGS

FIG. 6 is a table showing the items of standardization in the crane according to the embodiment.

FIG. 7 is a side view showing an upper rotating body of a crane according to a second embodiment of the present invention.

BEST MODE FOR CARRYING OUT THE INVENTION

Figure 20:
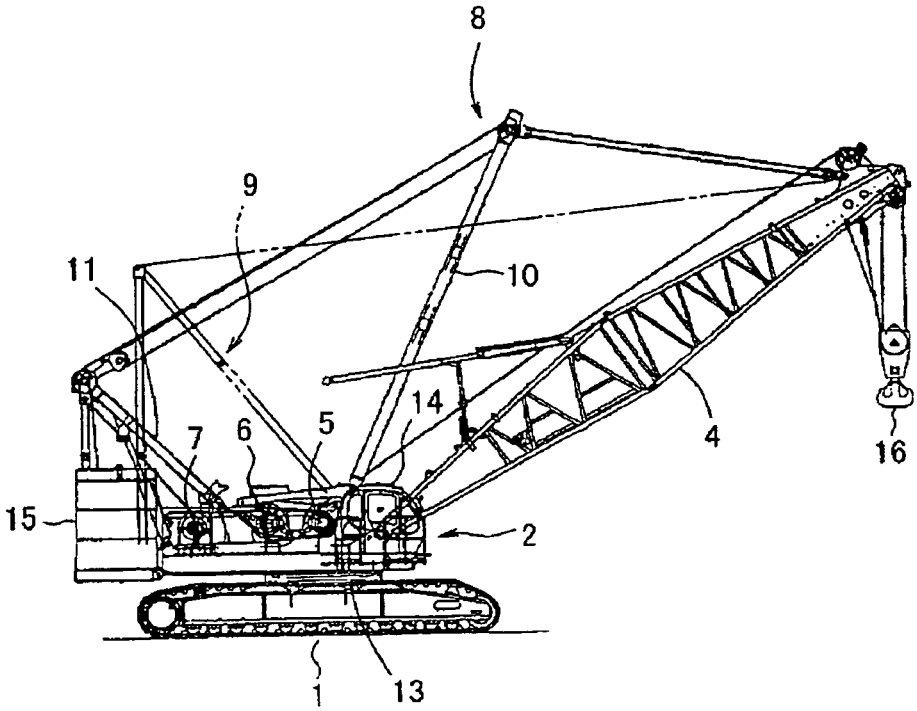
FIG. 20 is a side view showing a crawler crane.
Figure 21:
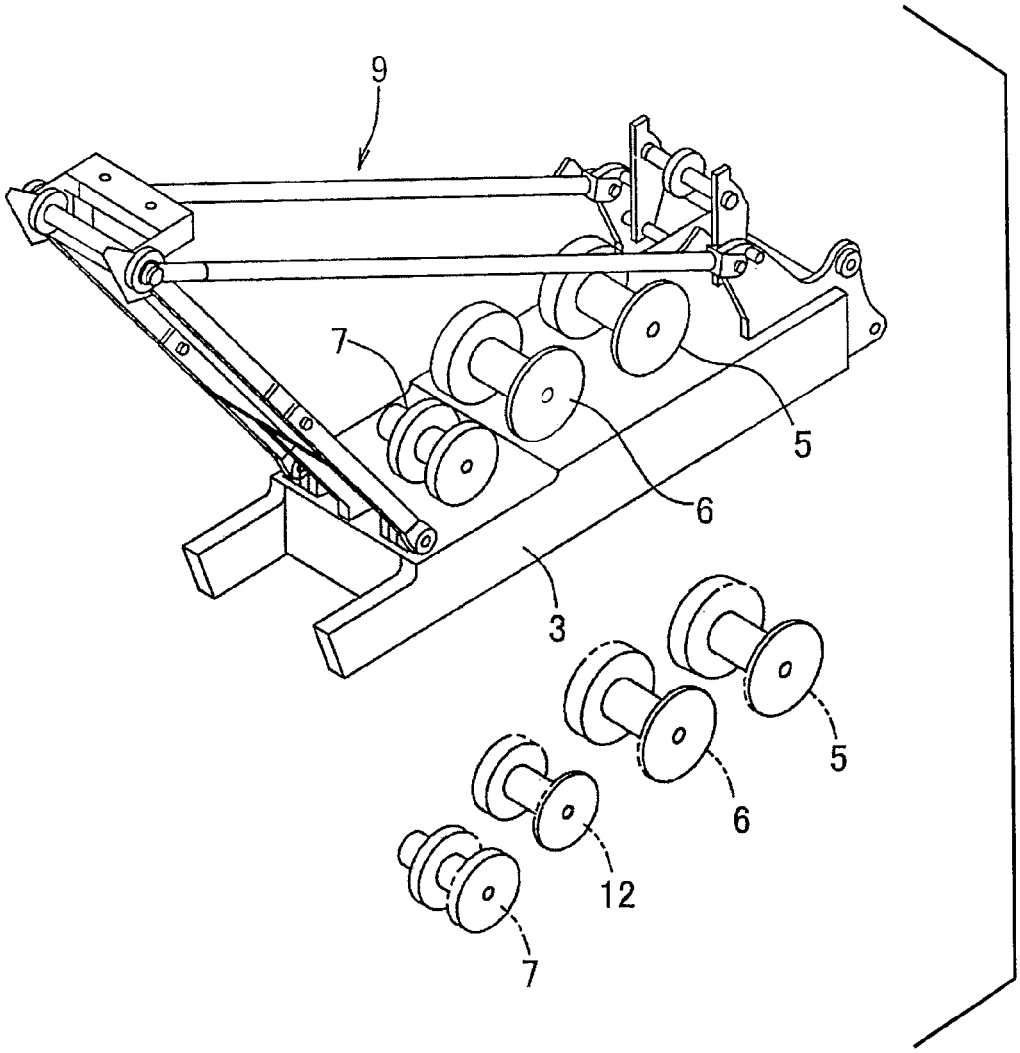
FIG. 21 is a perspective view of an upper rotating body in a crawler crane.

In the following embodiments, a crawler crane is taken as an example of a crane to which the present invention is applied. The crawler crane has a structure shown in FIG. 20. In the embodiments, the same reference numerals will be used to designate the same components as those shown in FIGS. 20 and 21, so that the description will be omitted.

First Embodiment

See FIGS. 1 to 6

Figure 1:
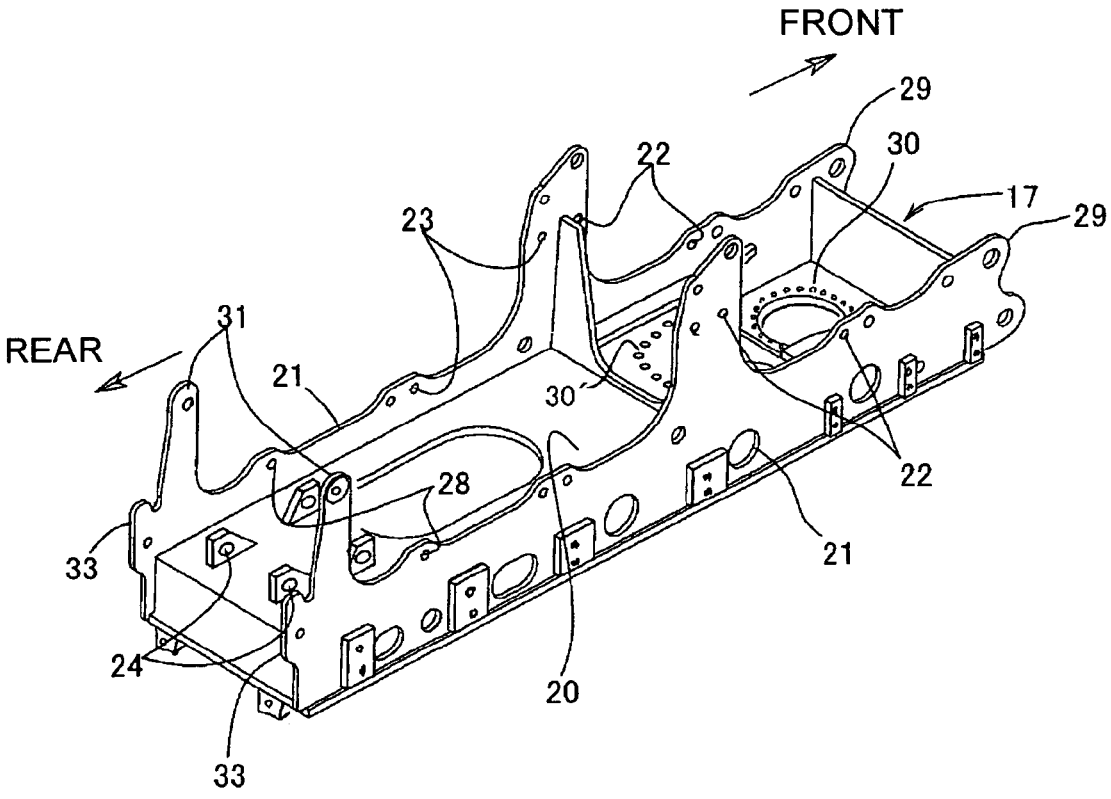
FIG. 1 is a perspective view of a rotating frame serving as a base of an upper rotating body of a crane according to a first embodiment of the present invention.
Figure 2:
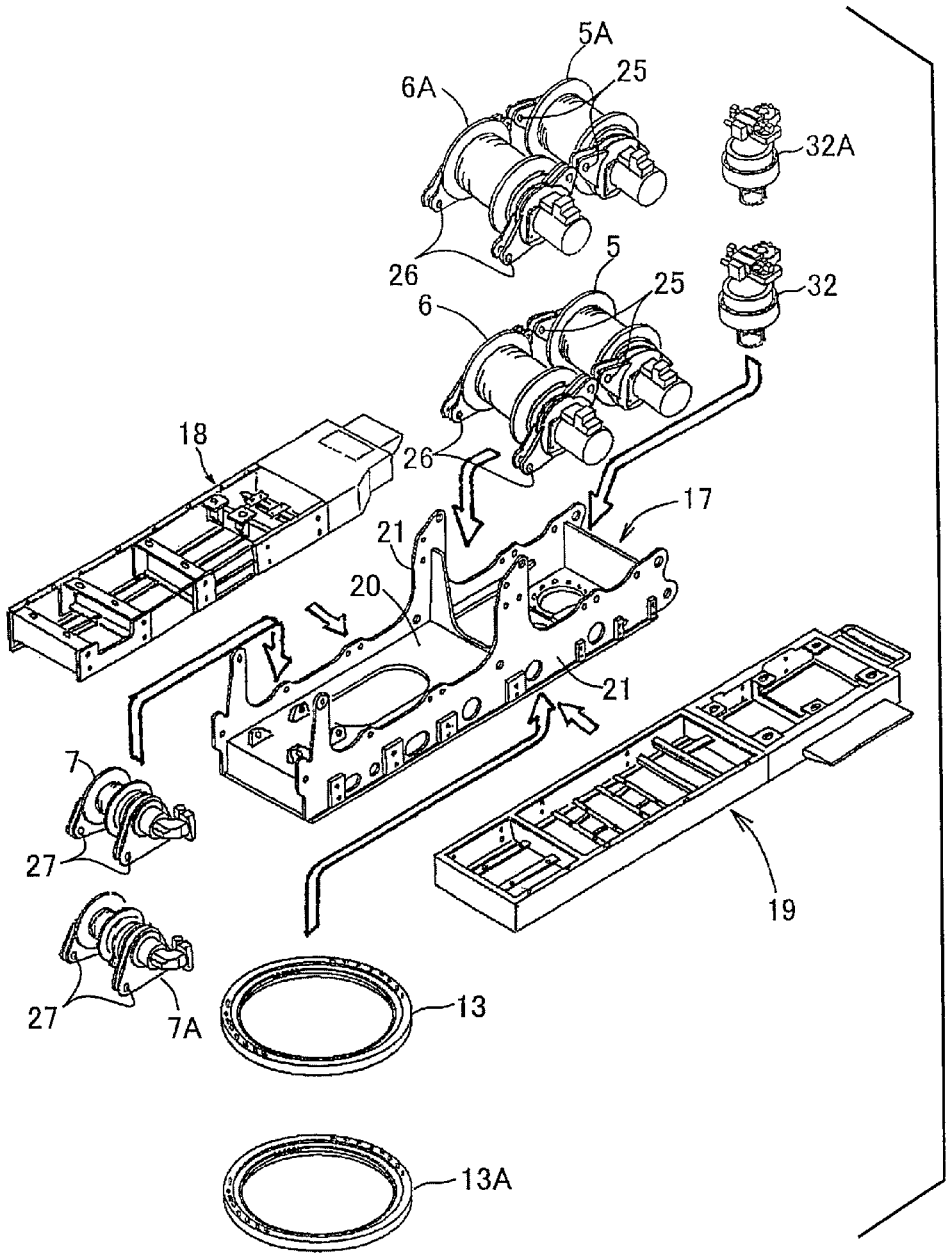
FIG. 2 is an exploded perspective view of the upper rotating body including the rotating frame.
Figure 3:
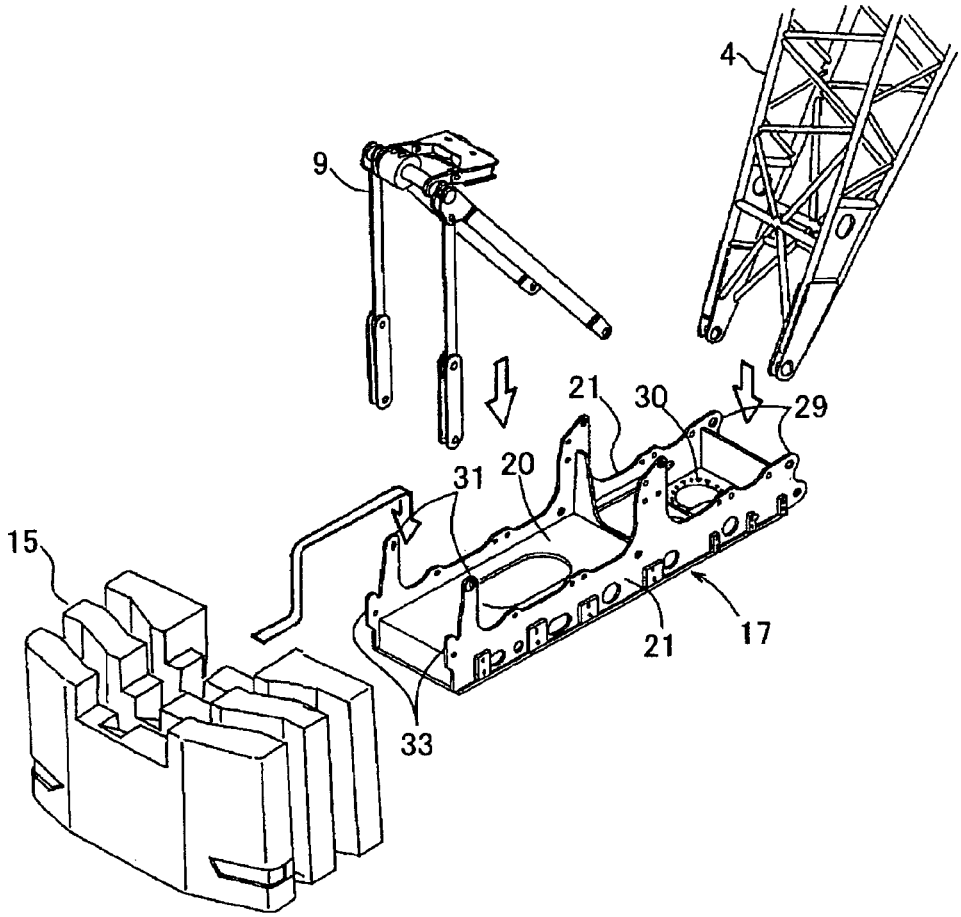
FIG. 3 is a perspective view showing the rotating frame, and a boom, a gantry, and a counterweight to be mounted thereon.
Figure 4:
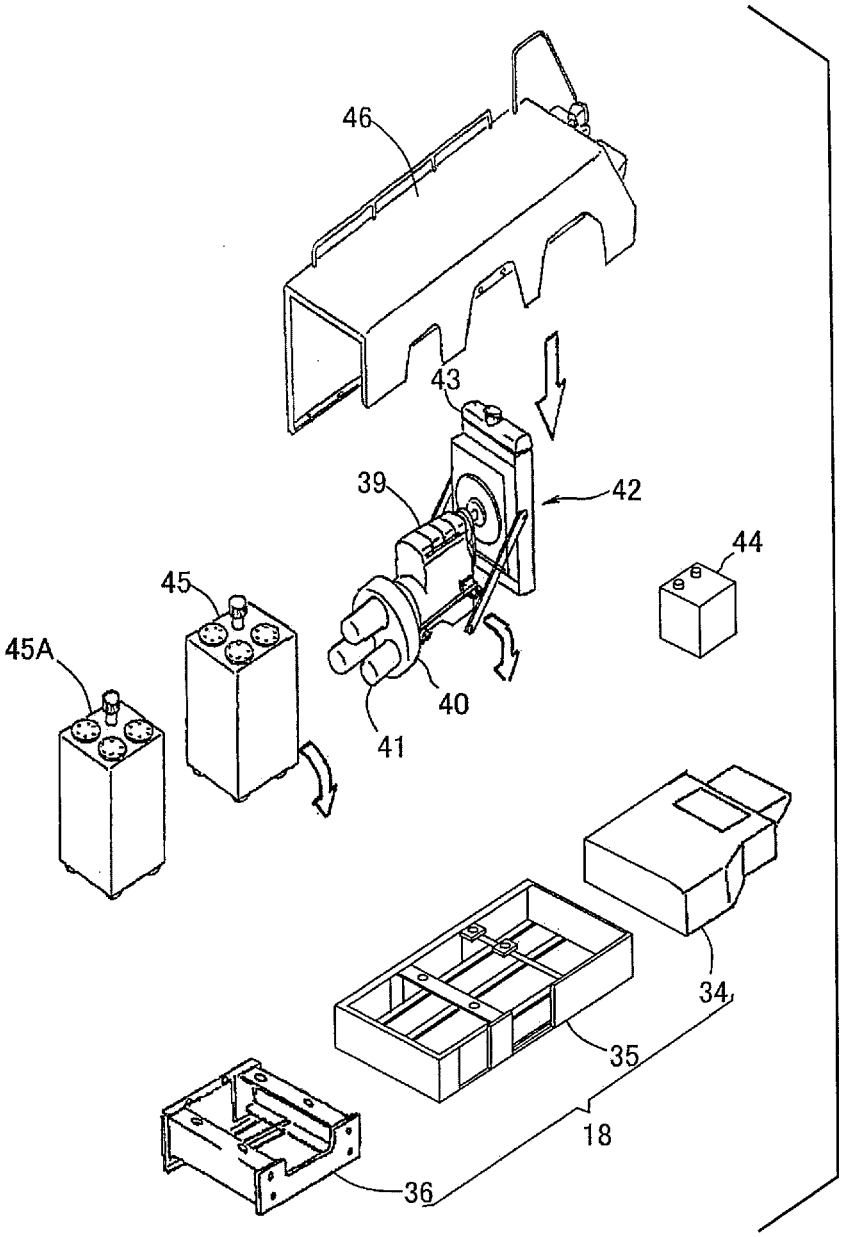
FIG. 4 is an exploded perspective view showing a left deck frame and pieces of equipment to be mounted thereon.
Figure 5:
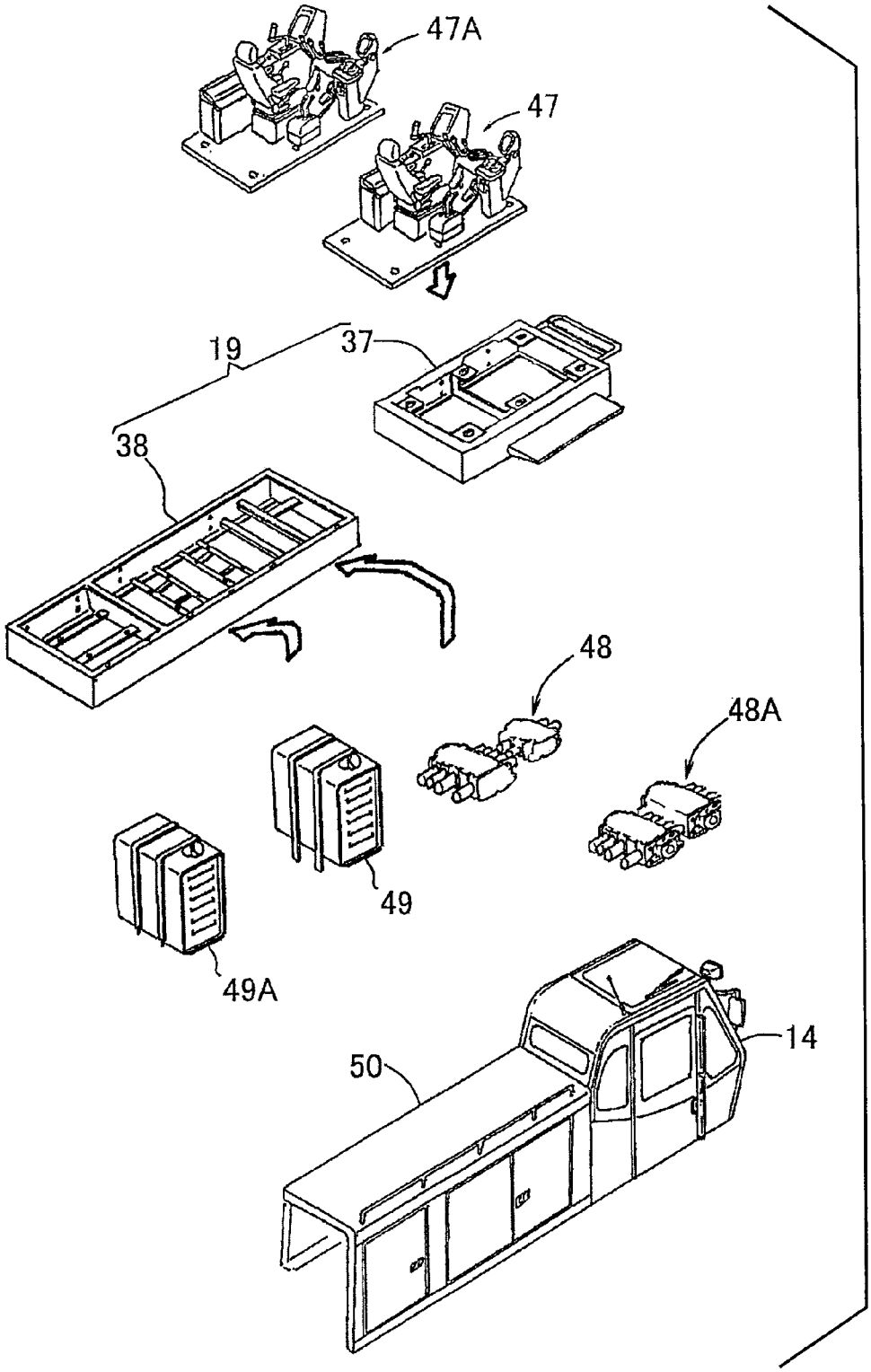
FIG. 5 is an exploded perspective view showing a right deck frame and pieces of equipment to be mounted thereon.

The upper rotating body of the crane according to this embodiment has a rotating frame 17 shown in FIGS. 1 to 3, which serves as a base. Left and right deck frames 18 and 19 shown in FIGS. 2, 4, and 5 are provided on both the left and right sides of the rotating frame 17.

Each component will hereinafter be described.

(i) Rotating Frame 17

As shown in FIG. 1, the rotating frame 17 includes a bottom plate 20 and left and right side plates 21, 21 as main components. The rotating frame 17 has a generally elongated rectangular shape as viewed from above.

Many crane models having different lifting capacities are divided into a plurality of classes, each class including a plurality of models. In each class, the shape and size of the rotating frame 17 are determined on the basis of the model having the largest lifting capacity.

More specifically, for example, all models whose lifting capacities range from tens of tonnes to hundreds of tonnes are divided into five classes from class A to class E. The class A includes a plurality of models having small capacities, and the class E includes a plurality of models having large capacities (A<B<C<D<E).

The number of classes is not limited to five.

In each of classes A to E, the machine having the largest lifting capacity (for example, 80 tonnes in the case of a class from 50 tonnes to 80 tonnes) serves as a standard. On the basis of the shape, area, strength, and so on necessary for this standard machine, a common rotating frame 17 is determined, and an upper rotating body is assembled on the basis of the rotating frame 17.

Hitherto, different rotating frames have been manufactured for different lifting capacities. However, if this configuration is adopted, the costs of the design, manufacturing, and storage of the rotating frame 17 can be dramatically reduced. In addition, due to the standardization of the rotating frame 17, the costs of parts and manufacturing can also be reduced.

Since it is not necessary to use different rotating frames 17, parts, and equipments for different models, the total productivity can be dramatically improved.

If a model change due to a destination change is requested during manufacturing, as long as the change is within the same class (for example, a change to 50 tonnes to 55 tonnes), the rotating frame 17 need not be changed, and it is only necessary to change the equipment mounted on the rotating frame. Therefore, the model change can be easily dealt with.

Since the rotating frame 17 is common not to all models but to a plurality of models in each of classes A to E (the range of standardization is limited), the balance between the size and cost of models can be maintained. For example, if the rotating frame 17 is determined on the basis of the model having the largest lifting capacity in all models, a small-capacity model has a too large rotating frame 17, and the cost increases. Such an adverse effect does not occur.

(ii) Main Winch 5, Subwinch 6, and Boom Raising and Lowering Winch 7 and Mounting Structures Thereof As shown in FIG. 1, a rotating frame 17 that is common in each class has main-winch mounting holes 22 for mounting a main winch 5, subwinch mounting holes 23 for mounting a subwinch 6, and boom-raising-and-lowering-winch mounting holes 24. The main-winch mounting holes 22 are located in the fronts of the left and right side plates 21, 21. The subwinch mounting holes 23 are located behind the main-winch mounting holes 22. The boom-raising-and-lowering-winch mounting holes 24 are located at the rear end of the bottom plate 20.

In order to avoid complicating the figures, reference numerals 22, 23, and 24 designating the winch mounting holes are shown only in FIG. 1.

As shown in FIG. 2, the main winch 5, the subwinch 6, and the boom raising and lowering winch 7 have main-winch-side mounting holes 25, subwinch-side mounting holes 26, and boom-raising-and-lowering-winch-side mounting holes 27, respectively. The numbers and arrangements of the winch-side mounting holes 25, 26, and 27 are the same as those of the rotating-frame-side winch mounting holes 22, 23, and 24. By means of the mounting holes 22 to 24 and 25 to 27, and not shown fastening means (for example, pins or bolts), the winches 5 to 7 are mounted on the rotating frame 17 one behind the other.

The numbers and arrangements of the rotating-frame-side winch mounting holes 22 to 24 and the winch-side mounting holes 25 to 27 are common to models in the same class.

Even in the same class, each of the winches 5 to 7 varies in size depending on model. However, regardless of the winch size, as long as the models are in the same class, the winches 5 to 7 can be mounted on the rotating frame 17 by means of the same mounting holes 22 to 24 and 25 to 27.

Therefore, the rotating-frame-side and winch-side mounting structures can be efficiently manufactured, the winches 5 to 7 can be easily mounted on the rotating frame 17, and the productivity can be further improved.

As described above, some cranes can be provided with a third winch (not shown). Therefore, third-winch mounting holes 28 are provided in the rears of both side plates 21, 21 of the rotating frame 17 (see FIG. 1).

The load of a model varies depending on whether it is used for construction or civil engineering. Therefore, each of the winches 5 to 7 is selected from two types (5 and 5A, 6 and 6A, 7 and 7A in FIG. 2) having different capacities.

In this case, if the rotating-frame-side and winch-side mounting portions for the two types of winches are separately provided, the structure is complicated, and the cost increases.

Therefore, in this embodiment, the winch-side mounting holes 25 to 27 and the rotating-frame-side winch mounting holes 22, 23, and 24 are common to the two types of main winches 5 and 5A, subwinches 6 and 6A, and boom raising and lowering winches 7 and 7A. By means of these, any one of the two types of winches can be mounted.

(iii) Rotating Frame 17, Boom 4, Gantry Apparatus 9, Rotation Bearing 13, and Counterweight 15

As shown in FIGS. 1 and 3, boom-foot mounting portions 29 are provided at the front ends of both side plates 21, 21, a rotation-bearing mounting portion 30 is provided in the front of the bottom plate 20, and gantry mounting portions 31 are provided in the upper rears of both side plates 21, 21. On these mounting portions 29 to 31, the lower end of a boom 4 (boom foot), a rotation bearing 13 shown in FIG. 2, the lower end of a gantry apparatus 9 are respectively mounted with fastening means (pins or bolts and nuts). In FIG. 2, reference numeral 32 designates a rotating apparatus combined with the rotation bearing 13.

In the same model, as with the winches 5 to 7, the rotation bearing 13 and the rotating apparatus 32 are also selected from two types (13 and 13A, 32 and 32A) according to use.

Therefore, with respect to the two types of rotation bearings 1313 and 13A and rotating apparatuses 32 and 32A, the configuration (the number and arrangement of the mounting holes) of the mounting portions thereof and the configuration of the rotating-frame-side mounting portions 30 and 30' (see FIG. 1) are common to the two types, and any one of the two types can be mounted.

Counterweight mounting portions 33 (reference numeral 33 is shown only in FIGS. 1 and 3) are provided at the lower rear ends of both side plates 21, 21 of the rotating frame 17. Horizontal pins (not shown) are provided in the front of the counterweight 15. The horizontal pins are fitted into the counterweight mounting portions 33 from above, and the counterweight 15 is thereby mounted.

(iv) Rotating Frame 17 and Left and Right Deck Frames 18 and 19

As shown in FIGS. 2, 4, and 5, the left and right deck frames 18 and 19 have an elongated rectangular shape as viewed from above.

The outer shapes and sizes (widths, lengths, and thicknesses) of both deck frames 18 and 19 are common to all models in the same class, although there are minor differences in, for example, the inner frame arrangement.

The equipment mounted on the deck frames may vary from model to model in the same class.

Therefore, the deck frames 18 and 19 of each model in the same class can be mounted on the rotating frame 17 that is common in the same class, by means of a common mounting structure.

In combination with the standardization of the rotating frame 17, this configuration improves the assemblability of the upper rotating body 2 and dramatically reduces the cost.

As shown in FIG. 4, the left deck frame 18 is divided into three sections: a front section 34, a middle section 35, and a rear section 36. As shown in FIG. 5, the right deck frame 19 is divided into two sections: a front section 37 and a rear section 38. Different pieces of equipment are mounted on different sections. Each section is detachably attached to the rotating frame 17.

With respect to the attaching structure of the sections to the rotating frame 17, detailed description and illustration will be omitted. The sections are detachably attached to the rotating frame 17 with, for example, mounting holes and fastening means (pins or bolts), as with the above-described winch mounting structure.

Since the left and right deck frames 18 and 19 are divided into a plurality of sections 34 to 36, 37, and 38 on which different pieces of equipment are mounted, subassemblies (combinations of a number of pieces of equipment) can be formed by mounting different pieces of equipment on different sections. Therefore, the assemblability is improved, and the subassemblies can be replaced separately.

Since the divided sections are separately attached to the rotating frame 17, the sections need not be joined to each other, for example, when different pieces of equipment are mounted on different sections so as to form subassemblies. Therefore, the assemblability is further improved.

The subassembling may be carried out as needed.

The following pieces of equipment are mounted on the deck frames 18 and 19.

As shown in FIG. 4, a power unit 42 includes an engine 39, a power divider 40, a hydraulic pump 41, and a radiator 43. The radiator 43 of the power unit 42 and a buttery 44 are mounted on the front section 34 of the left deck frame 18.

The engine 39, the power divider 40, and the hydraulic pump 41 of the power unit 42 are mounted on the middle section 35. A hydraulic oil tank 45 is mounted on the rear section 36.

In FIG. 4, reference numeral 46 designates a left guard, which is attached to and across the sections 34 to 36 so as to cover the above pieces of equipment.

As shown in FIG. 5, an operating unit 47 is mounted on the front section 37 of the right deck frame 19. Crane operations such as a winch operation, a traveling operation, and a boom operation are performed with this operating unit 47. In addition, a cabin 14 is mounted on the front section 37 so as to surround the operating unit 47.

A hydraulic control unit (control valve) 48 for performing various hydraulic controls during crane working and a fuel tank 49 are mounted on the rear section 38.

In FIG. 5, reference numeral 50 designates a right guard, which is attached to the rear section 38 so as to cover the hydraulic control unit 48 and the fuel tank 49. This right guard 50 may be integrated with the cabin 14 in advance and may be mounted on the right deck frame 14 together with the cabin 14. Alternatively, the right guard 50 may be mounted on the right deck frame 14 separately from the cabin 14.

Each piece of equipment mounted on both deck frames 18 and 19 varies in size depending on working use (construction or civil engineering) even in the same class. In this crane, the mounting structure of each piece of equipment on the deck frames 18 and 19 (for example, in the case of mounting with mounting holes and fastening means, the number and arrangement of the mounting holes) is common to all models in the same class.

Therefore, the equipment can be easily mounted, and productivity can be further improved.

FIG. 6 shows items of standardization in this crane. In the figure, branch numerals. 1, 2 . . . of classes A to E show models in each class. Common I to common V show that each element is common in each class.

As with the winches 5 to 7, the power unit 42 and the hydraulic oil tank 45 mounted on the left deck frame 18, and the operating unit 47, the hydraulic control unit 48, and the fuel tank 49 mounted on the right deck frame 19 also vary in necessary capacity and size depending on working use (construction or civil engineering). With respect to pieces of equipment except for the power unit 42, FIG. 5 shows two types of them (one of two types is designated by a reference numeral with branch letter A).

Also for each of these pieces of equipment, the mounting structure on the rotating frame 17 (for example, the number and arrangement of mounting holes in the rotating frame 17 and mounting holes in the piece of equipment) is common, and any one of the two types can be mounted.

Also for the boom 4, the gantry apparatus 9, and the counterweight 15, it is possible to prepare different sizes of them and mount them on the rotating frame 17 with common mounting structures.

The number of types of each piece of equipment mounted on the rotating frame 17 or the deck frames 18 and 19 with a common mounting structure is not limited to two but may be three or more.

Second Embodiment

See FIGS. 7 to 19

The second embodiment can be carried out in combination with the first embodiment. However, for the sake of convenience, the second embodiment will be described as a separate embodiment. In the second embodiment, the same reference numerals will be used to designate the same components as those in the first embodiment, so that the description will be omitted.

In the second embodiment, as in the first embodiment, models in the same class share a common rotating frame 17. The mast apparatus 8 and the gantry apparatus 9 serving as boom raising and lowering apparatuses are mounted on the rotating frame 17 with common mounting portions. With respect to the winches 5 to 7 and 12, a plurality of types of winches having different sizes are mounted on the rotating frame 17 with a common mounting portion.

The upper rotating body shown in FIG. 7 uses a mast apparatus 8 as a boom raising and lowering apparatus, and has three winches: a main winch 5, a subwinch 6, and a boom raising and lowering winch 7. This upper rotating body will hereinafter be referred to as "first type upper rotating body."

Figure 8:
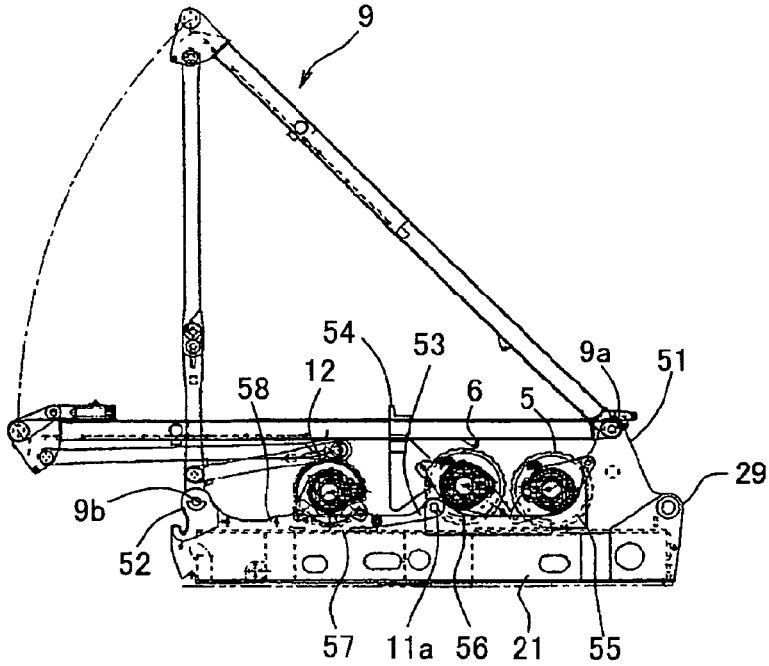
FIG. 8 is a side view of an upper rotating body including a different boom raising and lowering apparatus from that in FIG. 7.

The upper rotating body shown in FIG. 8 uses a gantry apparatus 9 as a boom raising and lowering apparatus, and has three winches: a main winch 5, a subwinch 6, and a boom raising and lowering winch 7. This upper rotating body will hereinafter be referred to as "second type upper rotating body."

Figure 9:
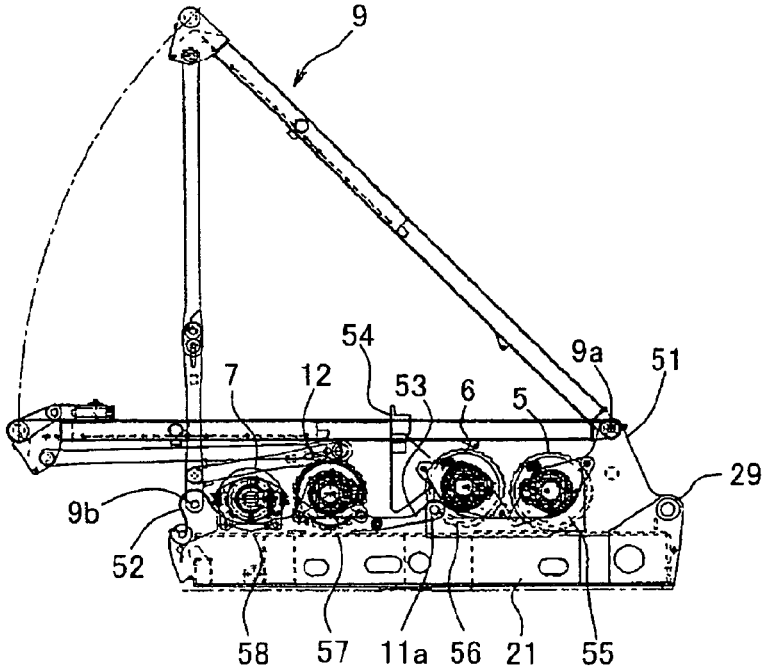
FIG. 9 is a side view of an upper rotating body including a different number of winches from those in FIG. 8.
Figure 10:
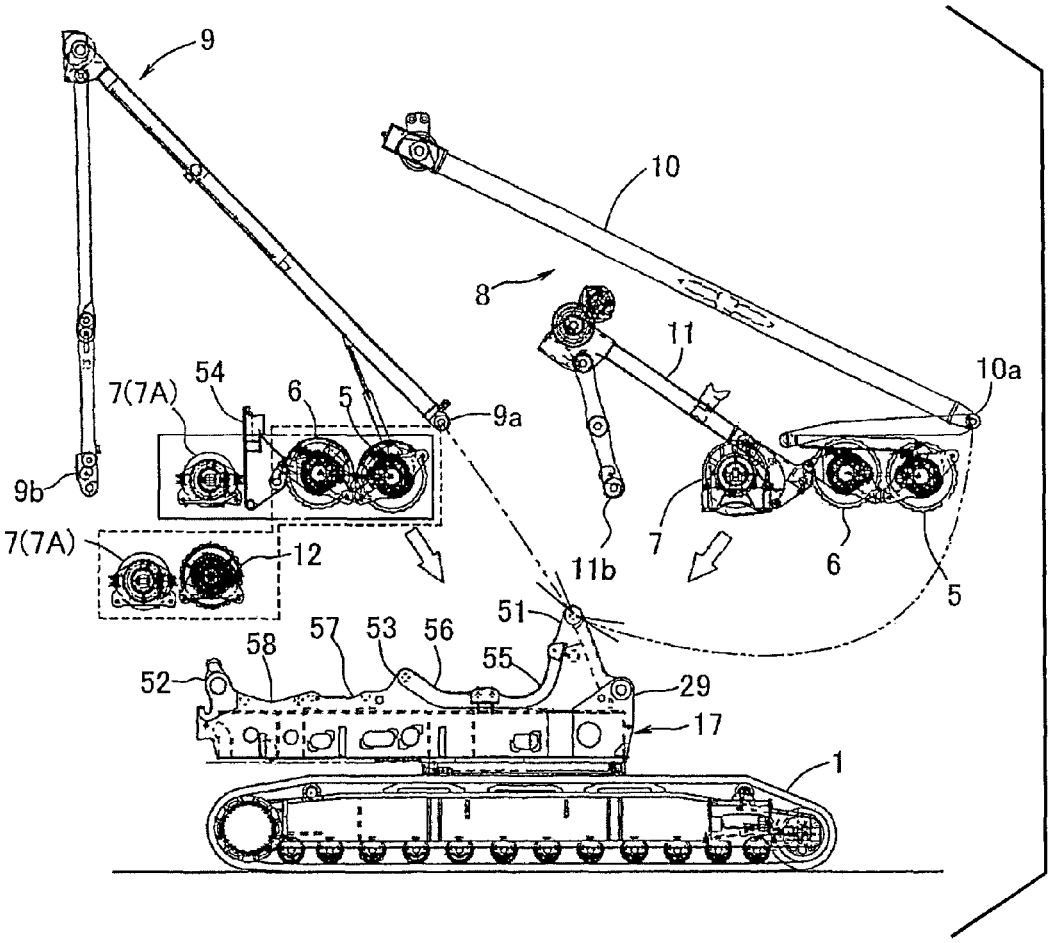
FIG. 10 is an exploded view showing the components of the upper rotating bodies of FIGS. 7 to 9.

The upper rotating body shown in FIG. 9 uses a gantry apparatus 9 as a boom raising and lowering apparatus, and has four winches: a main winch 5, a subwinch 6, a third winch 12, and a boom raising and lowering winch 7. This upper rotating body will hereinafter be referred to as "third type upper rotating body."

(I) Mounting Structure of Boom Raising and Lowering Apparatus

As shown in FIGS. 7 to 10, a first common mounting portion 51 is provided at the front end of the rotating frame 17, and a second common mounting portion 52 is provided at the rear end of the rotating frame 17. Both mounting portions are common to the mast apparatus 8 and the gantry apparatus 9 (common boom-raising-and-lowering-apparatus mounting portions).

As a mounting portion dedicated to the mast apparatus, a small-gantry mounting portion 53 is provided behind the first common mounting portion 51. A front fulcrum 11*a* of the small gantry 11 is mounted on the small-gantry mounting portion 53.

As shown in FIGS. 7 to 10, a front fulcrum 9*a* of the gantry apparatus 9 or a fulcrum 10*a* of a mast 10 of the mast apparatus 8 is mounted on the first common mounting portion 51.

A rear fulcrum 9*b* of the gantry apparatus 9 or a rear fulcrum 11*b* of the small gantry 11 of the mast apparatus 8 is mounted on the second common mounting portion 52.

When the gantry apparatus 9 is selected as a boom raising and lowering apparatus (the mast apparatus 8 is not selected), the small-gantry mounting portion 53 is used as a mounting portion on which a back-stop receiver 54 (see FIG. 10) is mounted. The back-stop receiver 54 receives the lower end of a back stop (not shown) for restricting the angle at which the boom tilts backward.

As described above, the mast apparatus 8 and the gantry apparatus 9 serving as boom raising and lowering apparatuses can be mounted on the rotating frame 17 with common mounting portions 51 and 52.

Therefore, it is only necessary to provide the common mounting portions 51 and 52 and the mounting portion 53 for the front fulcrum of the small gantry as mounting portions for the boom raising and lowering apparatus. Therefore, the rotating frame 17 can be standardized regardless of type of the boom raising and lowering apparatus.

Due to the standardization of the rotating frame 17 in terms of mounting structure of the boom raising and lowering apparatus, parts for mounting the boom raising and lowering apparatus (for example, pins) can also be standardized. This reduces the cost and facilitates inventory control. If a destination change is requested in the middle of assembling, the specifications of the crane can be smoothly changed, and therefore a quick delivery is possible.

In addition, due to the standardization of the rotating frame 17 in terms of mounting structure of the boom raising and lowering apparatus, the rotating frame 17 can be shared by a plurality of models.

That is to say, if different boom-raising-and-lowering-apparatus mounting structures are provided in the rotating frame 17 for different types of boom raising and lowering apparatuses to be used, the effect of sharing a common rotating frame 17 by a plurality of models is degraded, or such sharing is impractical. However, due to the standardization of the boom-raising-and-lowering-apparatus mounting structure, the basic objective of standardization of the rotating frame 17 can be practically achieved.

(II) Winch Mounting Structure

As shown in FIGS. 7 to 10, the rotating frame 17 is provided with four winch mounting portions: first, second, third, and fourth winch mounting portions 55, 56, 57, and 58 in this order from the front, for mounting winches.

In the first type upper rotating body shown in FIG. 7 (mast type, three winch type) and the second type upper rotating body shown in FIG. 8 (gantry type, three winch type), a main winch 5, a subwinch 56, and a boom raising and lowering winch 7 are mounted on the first, second, and third winch mounting portions 55, 56, and 57, respectively.

In the case of the third type upper rotating body shown in FIG. 9 (gantry type, four winch type), the main winch 5 and the subwinch 6 are unchanged, and an optional winch (third winch 12) is mounted on the third winch mounting portion 57, and the boom raising and lowering winch 7 is mounted on the fourth winch mounting portion 58.

In this embodiment, the standard winches, that is to say, the main winch 5, the subwinch 6, and the boom raising and lowering winch 7 are common to each type of upper rotating body, and mounting portions dedicated therefor (the first, second, and fourth mounting portions 55, 56, and 58) are also common.

The boom raising and lowering winch 7 and the third winch 12 that are selectively mounted on the third winch mounting portion 57 are generally different from each other in size (in the axial direction or the radial direction or both). In addition, there are various sizes of third winches 12.

In this case, if a winch mounting structure tailored to the size of a winch to be mounted is provided in the rotating frame 17, the standardization of the rotating frame 17 is impossible in terms of winch mounting, and the basic objective of standardization of the rotating frame 17 cannot be practically achieved. It is possible to provide a plurality of types of mounting structures corresponding to a plurality of sizes of winches at the same position. However, this is impractical because the structure is complicated too much.

In this embodiment, various types of winches (boom raising and lowering winch 7, third winch 12) can be mounted on the third winch mounting portion 57 as described below.

Figure 11:
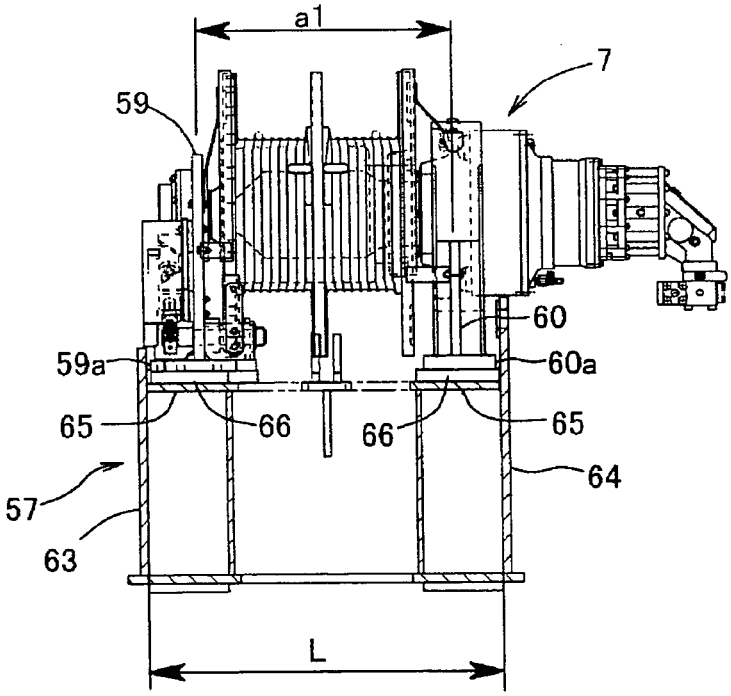
FIG. 11 is a rear view showing a mounting state of a boom raising and lowering winch on a third winch mounting portion of an upper rotating body.
Figure 12:
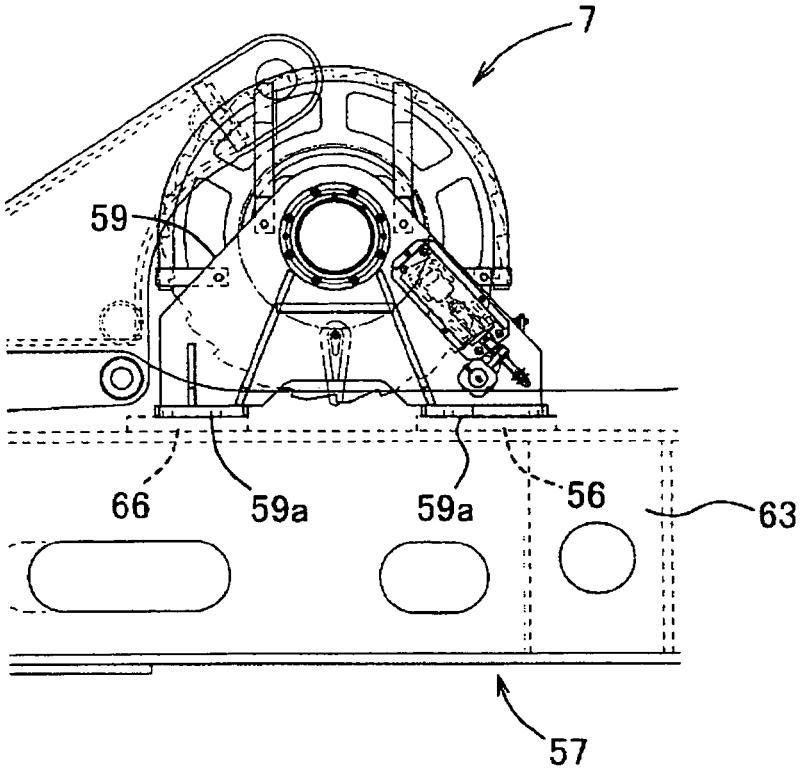
FIG. 12 is a left side view showing the same.
Figure 13:
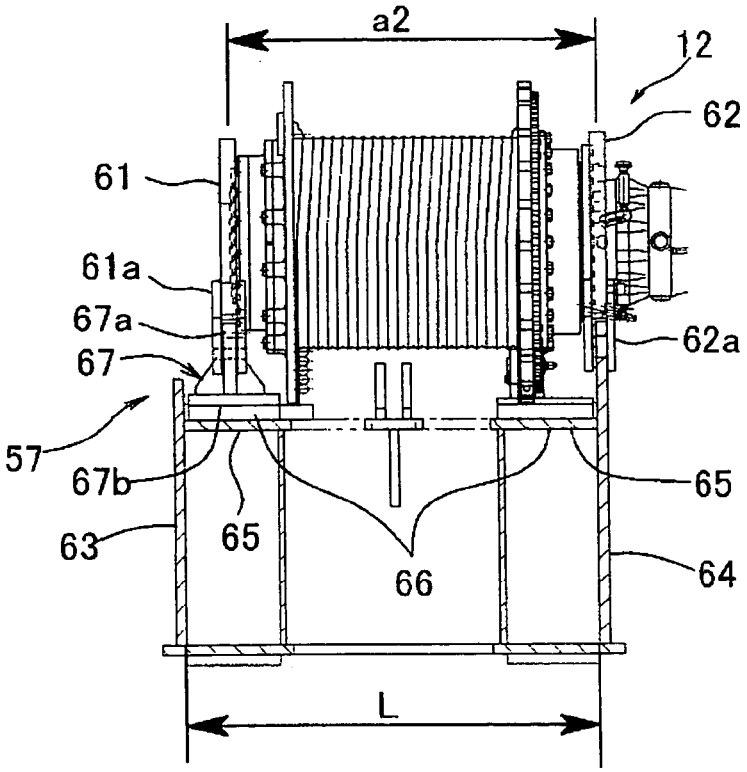
FIG. 13 is a rear view showing a mounting state of a third winch on the third winch mounting portion.
Figure 14:
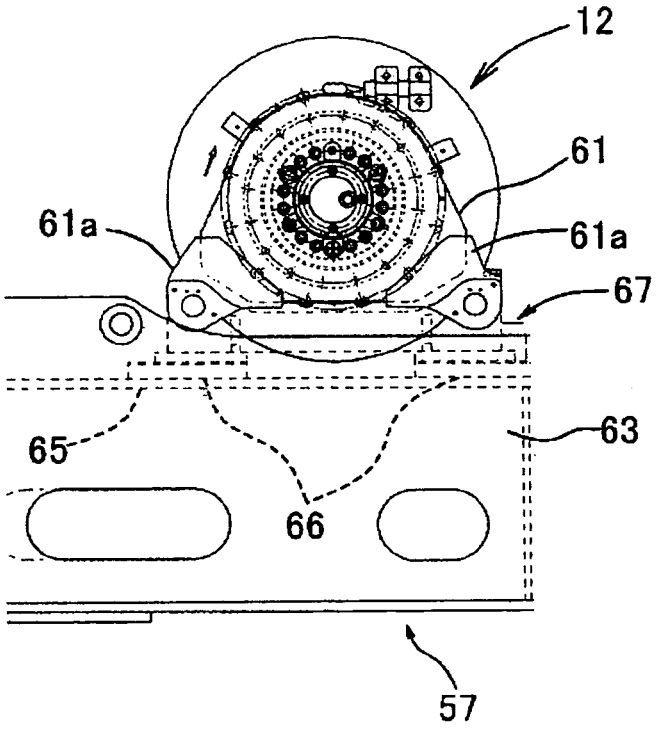
FIG. 14 is a left side view showing the same.

In FIGS. 11 and 12, a winch whose axial size is small (boom raising and lowering winch 7) is mounted on the third winch mounting portion 57. In FIGS. 13 and 14, a winch whose axial size is large (third winch 12) is mounted on the third winch mounting portion 57.

Winch plates 59 and 60 are provided on either side in the axial direction of the winch 7. Winch plates 61 and 62 are provided on either side in the axial direction of the winch 12. In accordance with the direction of FIGS. 11 and 13, the winch plates 59 and 61 and the winch plates 60 and 62 will hereinafter be referred to as left winch plates 59 and 61 and right winch plates 60 and 62, respectively.

As shown in FIG. 11, both winch plates 59 and 60 of the boom raising and lowering winch 7 have horizontal seat portions 59*a* and 60*a* at the lower ends, that is to say, have an inverted T-section, and are fixed to either side in the axial direction of the winch 7.

In contrast, both winch plates 61 and 62 of the third winch 12 are vertical plates having two-forked engaging portions 61*a* and 62*a* at the lower ends. The winch plates 61 and 62 are fixed to either side in the axial direction of the winch 12, with the engaging portions 61*a* and 62*a* projecting downward.

The third winch mounting portion 57 includes left and right vertical plates 63 and 64 for supporting winch plates, and a horizontal plate 65. The vertical plates 63 and 64 are provided at both ends in the width direction of the rotating frame 17. The horizontal plate 65 is disposed between the vertical plates 63 and 64. In addition, seat plates 66, 66 for supporting winch plates are provided on either side in the width direction of the horizontal plate 65.

In FIGS. 11 and 13, the distances a1 and a2 between both winch plates are used to show the difference in the axial size between the winches 7 and 12, and a1 is less than a2.

Reference letter L designates the distance between the inner surfaces of both vertical plates 63 and 64. The boom raising and lowering winch 7 shown in FIGS. 11 and 12 is shorter than the distance L. The third winch 12 shown in FIGS. 13 and 14 is longer than the distance L.

In this winch mounting structure, for the small-sized boom raising and lowering winch 7, as shown in FIG. 11, the seat portions 59*a* and 60*a* of both winch plates 59 and 60 are bolted to the seat plates 66, 66, and the winch 7 is thereby mounted on the third winch mounting portion 57.

In contrast, the large-sized third winch 12 cannot be placed between both vertical plates 63 and 64. Therefore, as shown in FIG. 13, the right winch plate 62 is supported such that the engaging portion 62*a* thereof is engaged with the upper end of the right vertical plate 64.

On the other hand, as for the left winch plate 61, the engaging portion 61*a* thereof is engaged with an adapter 67, and the adapter 67 is attached to the seat plate 66.

The adapter 67 includes a vertical supporting portion 67*a* and a horizontal mounting portion 67*b*. The supporting portion 67*a* is engaged with the engaging portion 61*a* of the winch plate 61, thereby supporting the winch plate 61. The mounting portion 67*b* is mounted on the horizontal plate 65 (seat plate 66). The mounting portion 67*b* is detachably attached to the seat plate 66 with bolts, for example.

The engaging portion 62*a* of the right winch plate 62 and the right vertical plate 64 are joined with pins. The engaging portion 61*a* of the left winch plate 61 and the supporting portion 67*a* of the adapter 67 are also joined with pins.

By this configuration, the difference in the axial size between the winches 7 and 12 can be absorbed, and any one of them can be mounted on the third mounting portion 57.

The third winch 12 can be selected from a plurality of types having different radial sizes. In this case, by using a plurality of types of adapters 67 having different heights, the variation in the radial size can be absorbed, and the third winch 12 can be mounted horizontally.

The shape and size of the adapter 67 are not limited to those shown in FIGS. 13 and 14. Various shapes and sizes of adapters 67 can be used.

Figure 15:
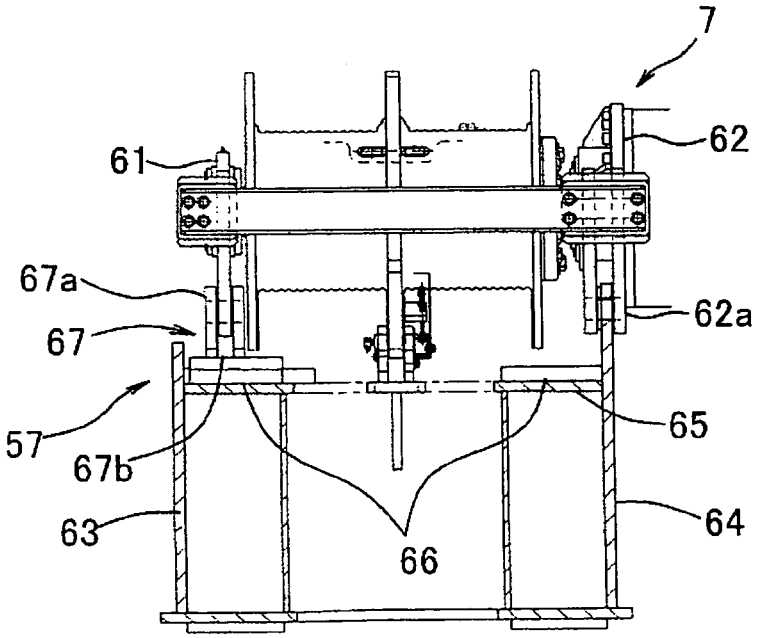
FIG. 15 is a rear view showing a mounting state of a boom raising and lowering winch that differs from that of FIG. 11 in size.
Figure 16:
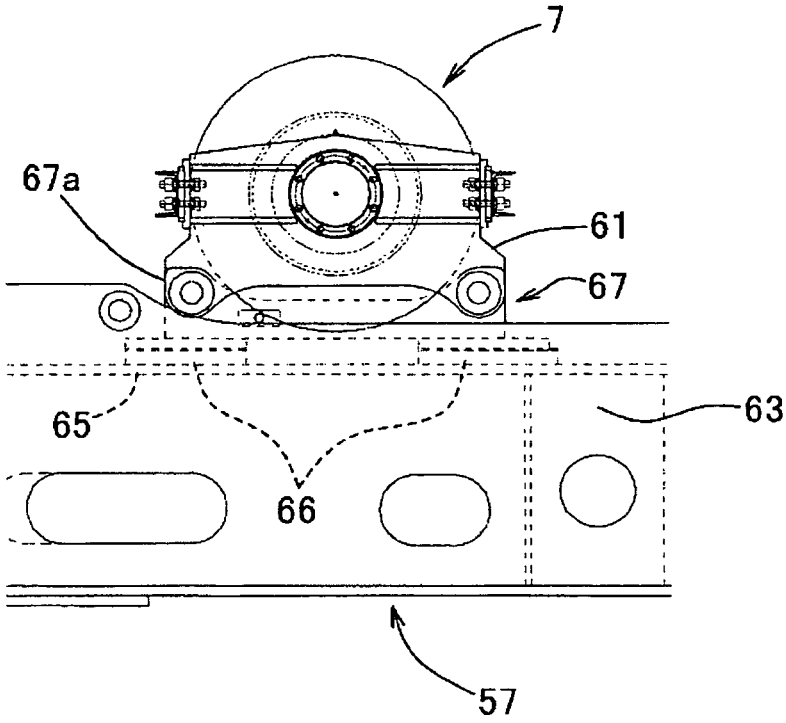
FIG. 16 is a left side view showing the same.

For example, as shown in FIGS. 15 and 16, when the left winch plate 61 is a simple vertical plate, the supporting portion 67*a* of the adapter 67 may be two-forked.

Figure 17:
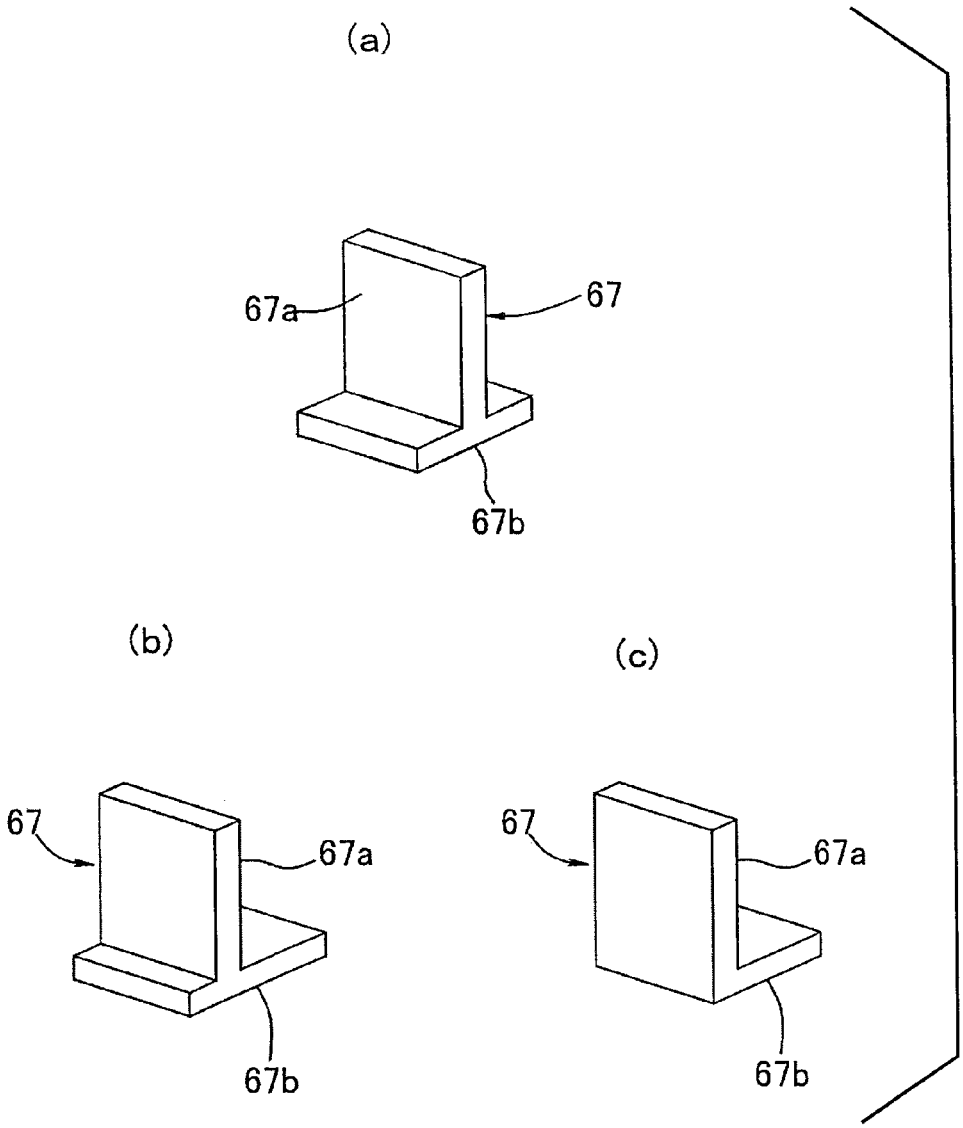
FIGS. 17(*a*) to 17(*c*) are perspective views showing the shapes of adapters used for mounting a winch on the third winch mounting portion.

In addition, the adapter 67 may have an inverted T-shape such that a vertical-plate-like supporting portion 67*a* meets the center of the horizontal mounting portion 67*b* as shown in FIG. 17(*a*). Alternatively, the adapter 67 may have an inverted T-shape such that the inward and outward protruding lengths of the mounting portion 67*b* from the supporting portion 67*a* are different as shown in FIG. 17(*b*). Alternatively, the adapter 67 may have an L-shape such that the mounting portion 67*b* protrudes only inward from the supporting portion 67*a* as shown in FIG. 17C.

As described above, by preparing a plurality of adapters 67 having different shapes and sizes and using them according to winch size, the variation in winch size can be dealt with.

When the third winch 12 is mounted on the third winch mounting portion 57, the boom raising and lowering winch 7 is mounted on the fourth winch mounting portion 58 shown in FIGS. 7 to 10. In other words, the fourth winch mounting portion 58 has a structure such that the boom raising and lowering winch 7 can be mounted thereon.

As described above, according to the crane of the second embodiment, the first to third type upper rotating bodies shown in FIGS. 7 to 9 share a common mounting structure for the boom raising and lowering apparatus and a common mounting structure for the winches. Therefore, a common rotating frame 17 can be shared.

Therefore, the basic objective of sharing the rotating frame 17 by a plurality of models can be completely achieved. This crane has a great advantage in many aspects such as cost, productivity, inventory control, and model change.

In addition, in the second embodiment, cylinders for raising and lowering the boom raising and lowering apparatuses (mast apparatus 8, gantry apparatus 9) also share a common mounting structure.

Figure 18:
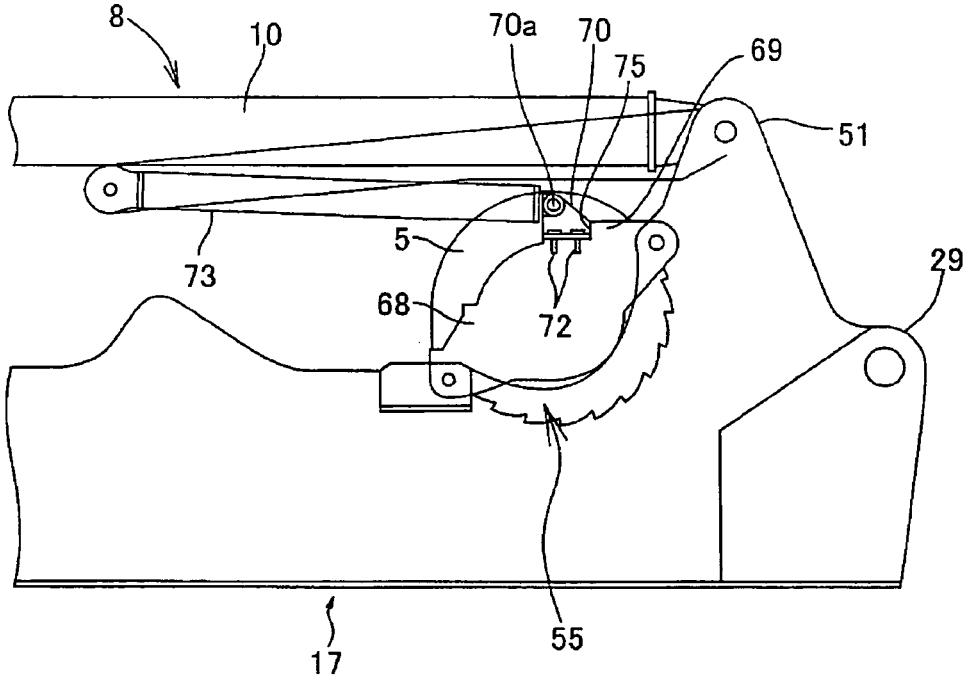
FIG. 18 is a side view showing a mounting structure of a mast cylinder in the upper rotating body shown in FIG. 7.
Figure 19:
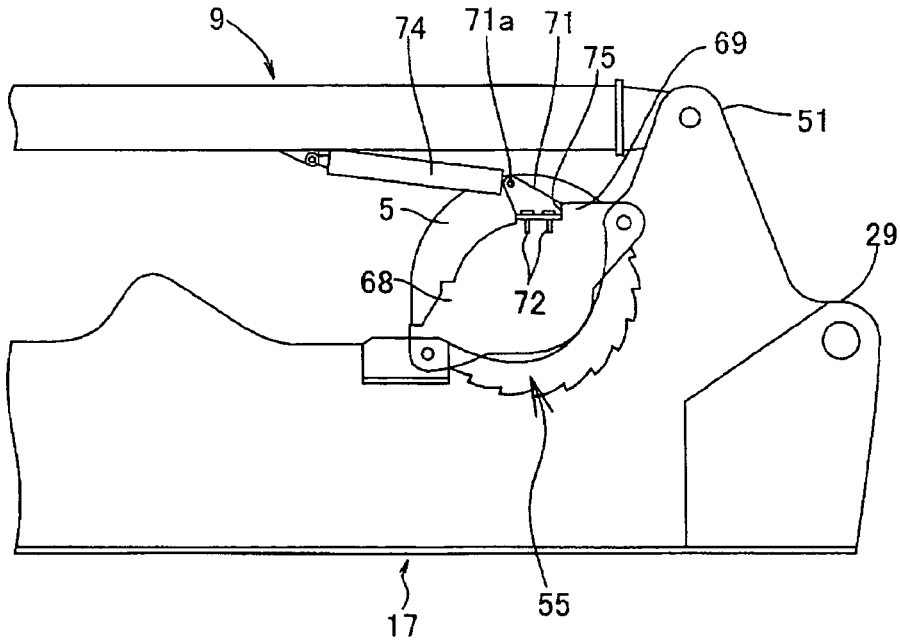
FIG. 19 is a side view showing a mounting structure of a gantry cylinder in the upper rotating body shown in FIG. 8 or 9.

That is to say, as shown in FIGS. 18 and 19, a cylinder mounting portion 69 is provided in the winch plate 68 of the main winch 5 mounted on the first winch mounting portion 55 of the rotating frame 17.

When the mast apparatus 8 shown in FIG. 7 is used as a boom raising and lowering apparatus, a mast cylinder bracket 70 is detachably attached to the cylinder mounting portion 69. When the gantry apparatus 9 shown in FIGS. 8 and 9 is used as a boom raising and lowering apparatus, a gantry cylinder bracket 71 is detachably attached to the cylinder mounting portion 69. Reference numerals 72, 72 designate mounting bolts.

The brackets 70 and 71 have pin holes 70*a* and 71*a*, respectively, at each upper portion protruding upward from the winch plate 68. The front end of the mast cylinder 73 or the gantry cylinder 74 is fixed with a pin at the pin hole 70*a* or 71*a*.

The upper portions of the brackets are shaped so that the mast cylinder 73 and the gantry cylinder 74 can be easily mounted thereon.

Due to this configuration, the front end of the cylinder 73 or 74 can be easily attached to the cylinder mounting portion 69, and one of the cylinders 73 and 74 can be easily changed to the other, simply by changing one of the brackets 70 and 71 to the other depending on which of the mast apparatus 8 (mast cylinder 73) and the gantry apparatus 9 (gantry cylinder 74) is used. Therefore, the cylinder mounting portion 69 and the winch plate 68 can be standardized regardless of whether the mast apparatus 8 or the gantry apparatus 9 is used.

In addition, in this embodiment, the cylinder mounting portion 69 of the winch plate 68 is provided with a reaction-force supporting surface 75. The surface 75 is L-shaped and in contact with both the lower surface and the front surface of the bracket 70 or 71. Both the horizontal and vertical components of the cylinder reaction force exerted on the bracket 70 or 71 are supported by the reaction-force supporting surface 75.

Therefore, the cylinder reaction force can be stably supported by the rotating frame 17. In addition, since the load on the bolts 72, 72 can be reduced, the size of the bolts can be reduced.

The shape of the reaction-force supporting surface 75 is not limited to an L-shape such that a horizontal surface adjoins a vertical surface as shown. The two intersecting surfaces constituting the reaction-force supporting surface 75 may tilt with respect to the horizontal and vertical directions.

Other Embodiments (1) In the second embodiment, only the third winch mounting portion 57 is standardized. Since the boom raising and lowering winch 7 and the third winch 12 are selectively mounted on the portion 57, the portion 57 is suitable for standardization. However, the other winch mounting portions 55, 56, and 58 can also be standardized in consideration of variation in winch size.

(2) In the first and second embodiments, the maximum number of winches is four. However, the present invention is not limited to this. The maximum number of winches may be five or more.

(3) As described in the above embodiments, the present invention is suitable for a crawler crane. However, the present invention can also be applied to a wheel crane such as an all terrain crane.

As described above, in the present invention, many models having different lifting capacities are divided into a plurality of classes, each class including a plurality of models. The plurality of models included in each class share a common rotating frame. The common rotating frame is based on the model having the largest lifting capacity in each class. An upper rotating body is constructed using the rotating frame as the base.

The rotating frame includes rotating-frame-side winch mounting portions. Each type of winch is provided with a winch-side mounting portion. The winch-side mounting portion is common to models in the same class. Each winch is mounted on the rotating frame by means of the rotating-frame-side winch mounting portion and the winch-side mounting portion.

Therefore, in a class, regardless of model, each winch can be mounted with the same mounting portion (for example, the same number of mounting holes in the same arrangement). Therefore, productivity can be further improved.

Left and right deck frames are provided on both the left and right sides of the rotating frame. At least the outer shapes and sizes of the left and right deck frames are common to all models in the same class.

The left and right deck frames are provided on both the left and right sides of the rotating frame. In response to the standardization of the rotating frame, the left and right deck frames are also standardized. At least the outer shapes and sizes of the left and right deck frames are common to all models in the same class. This facilitates the design, manufacturing, and mounting of the deck frames.

Equipment (for example, an engine) is mounted on the deck frames by means of mounting portions that are common to models in the same class. This facilitates the mounting of the equipment and further improves productivity.

The left and right deck frames are divided into a plurality of sections on which different pieces of equipment are mounted. Therefore, it is possible to mount different pieces of equipment on different sections so as to form subassemblies. This further improves assemblability.

The divided sections are separately mounted on the rotating frame. Therefore, the sections need not be joined to each other, for example, when different pieces of equipment are mounted on different sections so as to form subassemblies. This improves assembling efficiency. In addition, when the equipment is changed, the changing work is easy because the sections can be replaced separately.

A plurality of types of sections are mounted on the rotating frame with a common mounting portion. This facilitates the mounting of the sections, the manufacturing of the mounting structure therefor, and the replacement of the sections.

Each section is detachably mounted on the rotating frame. Therefore, when the equipment is changed according to use (construction or civil engineering), each subassembly can be easily replaced.

The mounting structure of the boom raising and lowering apparatus (mast apparatus, gantry apparatus) on the rotating frame, or at least one winch mounting structure, or both are standardized.

First and second common mounting portions are provided as common mounting portions for the boom raising and lowering apparatus. One of the front fulcrum of the gantry apparatus and the fulcrum of the mast of the mast apparatus is selectively mounted on the first common mounting portion. One of the rear fulcrum of the gantry apparatus and the rear fulcrum of the small gantry of the mast apparatus is selectively mounted on the second common mounting portion. Therefore, the mounting structure for the boom raising and lowering apparatus can be standardized.

It is only necessary to change the bracket depending on which of the gantry cylinder for the gantry apparatus and the mast cylinder for the mast apparatus is mounted. Therefore, regardless of the type of bracket, the member having the cylinder mounting portion can be standardized.

The cylinder mounting portion can sufficiently support the cylinder reaction force. Therefore, the size of the fixing means for fixing the bracket to the cylinder mounting portion can be reduced.

Since a common winch mounting portion for the optional winch is provided, various sizes of optional winches can be mounted.

The rotating frame is provided with the same number of winch mounting portions as the maximum number of winches (four in the above example). One of the winch mounting portions is shared by the boom raising and lowering winch (standard winch) in the three-winch type and the third winch (optional winch) in the four-winch type. Therefore, the winch mounting structure on the rotating frame side can be common to the three-winch type and the four-winch type.

A horizontal plate and a vertical plate support the winch plates, and an adapter is disposed between the horizontal plate and one of the winch plates. Variations in the winch sizes in the axial direction and the radial direction are thereby absorbed. Therefore, different sizes of winches (for example, a standard winch and an optional winch) can be mounted on a winch mounting portion.

The horizontal mounting portion of the adapter is attached to the horizontal plate. Therefore, by using a plurality of types of adapters whose horizontal mounting portions have different width, a large variation in the winch size in the axial direction can be absorbed.

INDUSTRIAL APPLICABILITY

The present invention relates to a mobile crane such as a crawler crane, and more specifically, it relates to a rotating frame of an upper rotating body. The present invention has the following useful effects. That is to say, total productivity (assemblability) can be improved, the cost can be reduced, and model change can be facilitated.

The invention claimed is:

1. A family of cranes each comprising a lower traveling body and an upper rotating body rotatably mounted on the lower traveling body, the upper rotating body including a rotating frame and lifting equipment mounted on the rotating frame, the lifting equipment including a boom and a plurality of types of winches, thereby allowing each crane to have a specified lifting capacity, wherein the family of cranes includes:

a first model crane having a first lifting capacity;

a second model crane having a second lifting capacity greater than the first lifting capacity;

a third model crane having a third lifting capacity greater than the second lifting capacity;

a fourth model crane having a fourth lifting capacity greater than the third lifting capacity;

a lifting capacity difference between the first model crane and the second model crane being different from a lifting capacity difference between the third model crane and the fourth model crane;

the first model crane and the second model crane each including a first type of rotating frame which has a first mounting space arrangement for mounting the lifting equipment of the second model crane; and the third model crane and the fourth model crane each including a second type of rotating frame which has a second mounting space arrangement for mounting the lifting equipment of the fourth model crane.

2. The family of cranes according to claim 1, wherein each of the first and second types of rotating frames in each respective class includes rotating-frame-side winch mounting portions for mounting the winches on the rotating frame, each type of winch is provided with a winch-side-mounting portion, the winch-side mounting portion for the first type of rotating frame being different from that for the second type of rotating frame, and each winch is mounted on the rotating frame by means of the rotating-frame-side winch mounting portion and the winch-side mounting portion.

3. The family of cranes according to claim 2, wherein left and right deck frames are further provided on both the left and right sides of the rotating frame, and at least the outer shapes and sizes of the left and right deck frames are replaceable between the first and second model cranes, or between the third and fourth model cranes.

4. The family of cranes according to claim 3, wherein another equipment is mounted on the left and right deck frames by means of mounting portions that are replaceable between the first and second model cranes, or between the third and fourth model cranes.

5. The family of cranes according to claim 3, wherein the left and right deck frames are divided into a plurality of sections on which different pieces of equipment are mounted.

6. The family of cranes according to claim 5, wherein the sections of the left and right deck frames are separately mounted on the rotating frame.

7. The family of cranes according to claim 6, wherein with respect to each section of the left and right deck frames, a plurality of types of sections on which different sizes of pieces of equipment are mounted according to the uses of the machine are mounted on the same type of rotating frame.

8. The family of cranes according to claim 6, wherein each section of the left and right deck frames is detachably mounted on the rotating frame.

* * * * *